US005644917A

United States Patent [19]

McWaters

[11] Patent Number: 5,644,917

[45] Date of Patent: Jul. 8, 1997

[54] KINEMATIC STIRLING ENGINE

[76] Inventor: Thomas David McWaters, 113 Miami Gardens Dr., Miami, Ariz. 85539

[21] Appl. No.: 645,077

[22] Filed: May 13, 1996

[51] Int. Cl.[6] ..... F01B 29/10

[52] U.S. Cl. ..... 60/517; 60/519; 60/526

[58] Field of Search ..... 60/517, 519, 526

[56] References Cited

U.S. PATENT DOCUMENTS 3,220,177 11/1965 Kohler ..... 60/526

4,885,017 12/1989 Fleischmann ..... 60/526

*Primary Examiner*—Ira S. Lazarus

*Assistant Examiner*—Alfred Basichas

[57] ABSTRACT

A hot gas engine operating with a Stirling cycle includes a hot chamber, displacer piston, regenerator, cold chamber, and power piston. A displacer piston is associated with a kinematic transmission train employing non-circular gears so as to convert rotary motion of a mainshaft into longitudinal piston movement and vice-versa. A power piston is associated with a kinematic transmission train employing non-circular gears so as to convert rotary motion of a mainshaft into longitudinal piston motion and vice-versa. The displacer piston and power piston relate to each other so that the engine working gas operates in close accordance with the theoretical four strokes comprising the Stirling cycle.

12 Claims, 4 Drawing Sheets

KINEMATIC STIRLING ENGINE

BACKGROUND OF THE INVENTION

The present invention relates to an engine operating with a Stirling cycle wherein the several moving parts are kinematically related to each other so that the engine working gas operates in a cycle consisting of four strokes.

The Stirling cycle engine in its theoretical form consists of four separate strokes which the engine working gas experiences. An expansion stroke allows the working gas to expand at a constant high temperature, during which stroke work is removed from the working gas while heat is added to the working gas from an external source. Following the expansion stroke the working gas is transferred from the environment that maintains the working gas at the constant high temperature to an environment that maintains the working gas at a constant low temperature. This transfer stroke is done at constant expanded working gas volume, and during the transfer stroke heat is removed from the working gas and stored in a device called a regenerator, for use later in the cycle. Theoretically no work is required to perform this transfer stroke since there is no change in the working gas volume. Following the high temperature to low temperature transfer stroke, the working gas volume is forced to contract at the constant low temperature, a stroke which requires heat to be removed from the working gas and work to be added to the working gas. The last stroke to complete the Stirling cycle consists of transferring the working gas from the environment that maintains the working gas at the constant low temperature back to the environment that maintains the working gas at the constant high temperature. This transfer stroke is done at constant contracted working gas volume, and during this transfer stroke the heat which was removed from the working gas during the previous transfer stroke and stored in the regenerator is returned to the working gas, reducing the amount of external heat that must be added to the working gas. Theoretically no work is required to perform this transfer stroke since there is no change in the working gas volume. When taken together the four strokes of the Stirling cycle theoretically equal the Carnot cycle, in which more heat has been added to the working gas than that removed, more work has been removed from the working gas than that added, and the net cycle work equals the work equivalent of the net cycle heat transferred multiplied by the efficiency fraction obtained by dividing the difference of the cycle high temperature and the cycle low temperature by the cycle high absolute temperature.

Hot gas engines designed to operate on the Stirling cycle fail to achieve the Carnot cycle for various reasons. Many of the reasons cannot be eliminated but only reduced, including those involving friction of working gas and engine components, those of heat transfer times being longer than instantaneous, those of heat being transferred in undesired directions, and those of portions of the working gas volume being in spaces such as clearances so the portions cannot be transferred.

A shortcoming that causes prior art hot gas engines to fail to achieve the Carnot cycle, which this invention ameliorates, is that said engines do not allow each of the four above-described strokes to be completed before the next stroke begins, so that simultaneously the working gas is operating in two different strokes. For example, the displacer piston and power piston of a Stirling engine equipped with a rhombic transmission are simultaneously moving at various times in their engine cycle. This allows the working gas volume to be either expanding or contracting while it is also being transferred, which lessens the degree to which the cycle can approach the theoretical Carnot cycle efficiency fraction.

SUMMARY OF THE PRESENT INVENTION

The object of the present invention is to provide an improved Stirling cycle engine by utilizing transmission trains which include non-circular gears to control the motions of the displacer piston and power piston in a relationship more ideally suited to attaining the Carnot cycle than prior art engines.

The preferred embodiment of the invention utilizes twin counterpart mainshafts rotating in opposite directions to balance vibrations, to reduce operating forces, and to provide multiple means of attaching the workload to the engine. Upon each mainshaft is affixed a non-circular displacer piston gear which engages with and drives a similar gear. Each driven displacer piston gear rotates about a shaft and each driven gear includes a crankpin, from which a connecting rod rotatively connects to a displacer piston by means of a crosshead yoke which allows the counterpart displacer piston gear driven by the other mainshaft to be connected. The rotation of each driven displacer piston gear about its shaft is irregular compared to the driving mainshaft rotation; that is the driven shaft rotates at maximum and minimum angular speeds that are changing while the driving mainshaft is rotating at a constant angular speed.

Upon each mainshaft is additionally affixed a non-circular power piston gear which engages with and drives a similar gear. Each driven power piston gear rotates about a shaft and each driven gear includes a crankpin, from which a connecting rod rotatively connects to a power piston by means of a crosshead yoke which allows the counterpart power piston gear driven by the other mainshaft to be connected. The rotation of each driven power piston gear about its shaft is irregular compared to the driving mainshaft rotation; that is the driven shaft rotates at maximum and minimum angular speeds that are changing while the driving mainshaft is rotating at a constant angular speed.

The above-described irregular relationships of rotations of the driven displacer piston gears and driven power piston gears when compared to the mainshaft rotation cause the motions of the displacer piston and the power piston to relate to each other so that the working gas contained within the engine cylinder spaces operates in four separate strokes. The four strokes are as defined by the theoretical Stirling cycle and consist of the working gas expansion at a constant high temperature, transfer of the working gas at constant volume from the high temperature environment to a low temperature environment, contraction of the working gas at a constant low temperature, and transfer of the working gas at constant volume from the low temperature environment back to the high temperature environment to complete the cycle.

The preferred embodiment of the present invention operates on relatively low working gas pressures, relatively low temperatures, and relatively few cycles per unit time so as to yield a relatively more durable engine. The preferred embodiment utilizes air as a working gas to reduce sealing concerns, reduce maintenance, and increase utility. The engine consists of many individual components of simple geometric shapes rather than fewer composite components, so as to allow appropriate materials of construction to be used for the various and disparate required functions, and for those components to be able to be singly replaced. The preferred embodiment reduces seal friction by utilizing relatively low operating pressures and short piston travel, and by requiring seals only on the power piston and only in low-temperature locations.

A Stirling cycle engine constructed in accordance with the concepts of the present invention achieves performance equal to prior art engines requiring either relatively higher pressures, relatively higher temperatures, relatively more cycles per unit time; or combinations thereof. Stirling engines are inherently quiet in their operation when their external heat source is by continuous combustion of fuel rather than cyclical cylinder combustions, and the same continuous combustion process offers means to control pollutants to the ecology. By being otherwise simple, durable, and demanding little maintenance, the present invention presents more utility to the general public than prior art engines operating on the Stirling cycle; for instance as a lawn mower engine.

BRIEF DESCRIPTION OF THE DRAWINGS

The accompanying drawings FIGS. 1 through 6 describe the present invention in its preferred embodiment, in which.

DETAILED DESCRIPTION OF THE PREFERRED EMBODIMENT

Figure 1:
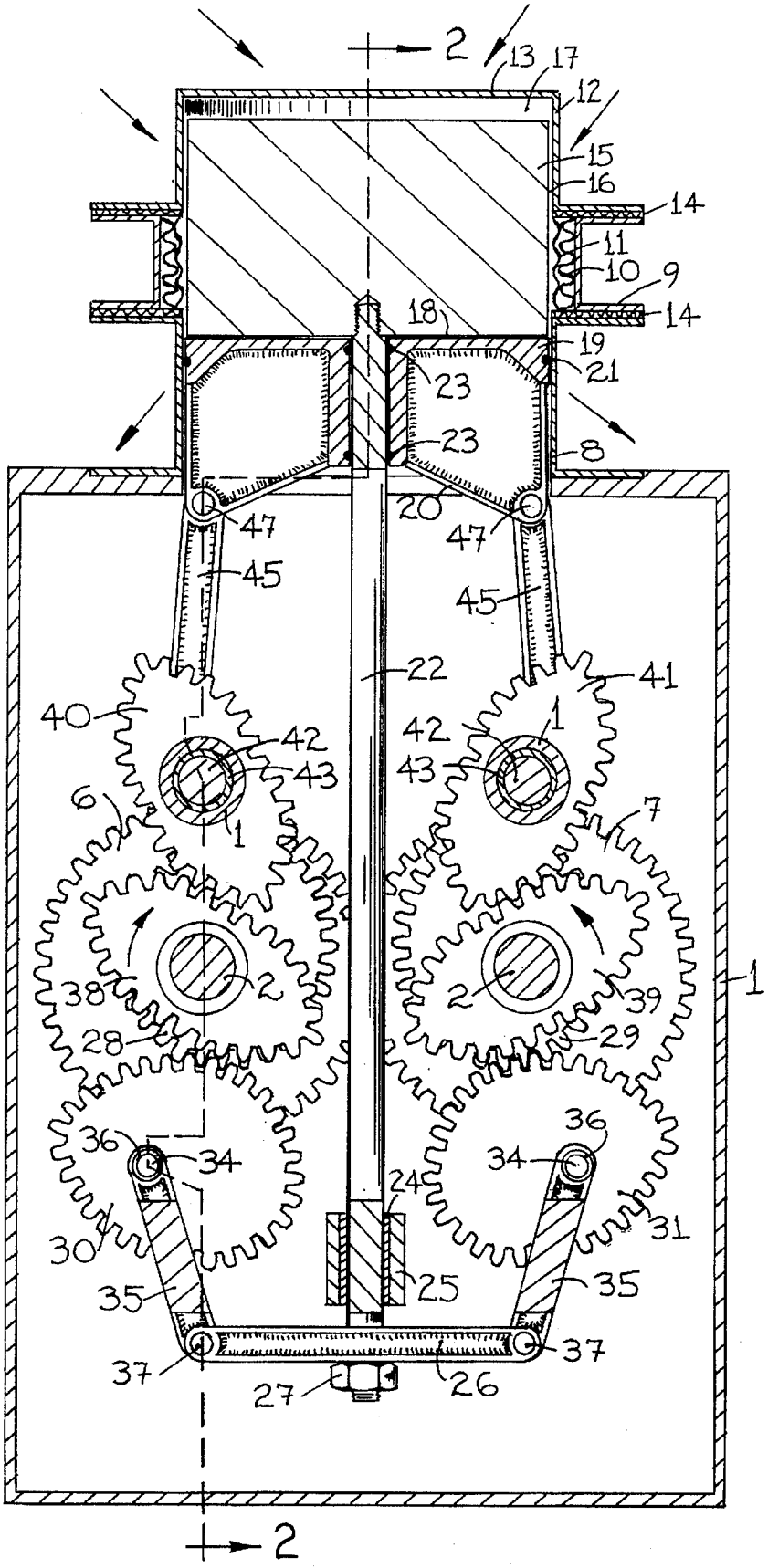
FIG. 1 is a transverse section view through a Stirling engine constructed in accordance with the preferred embodiment of the present invention.
Figure 2:
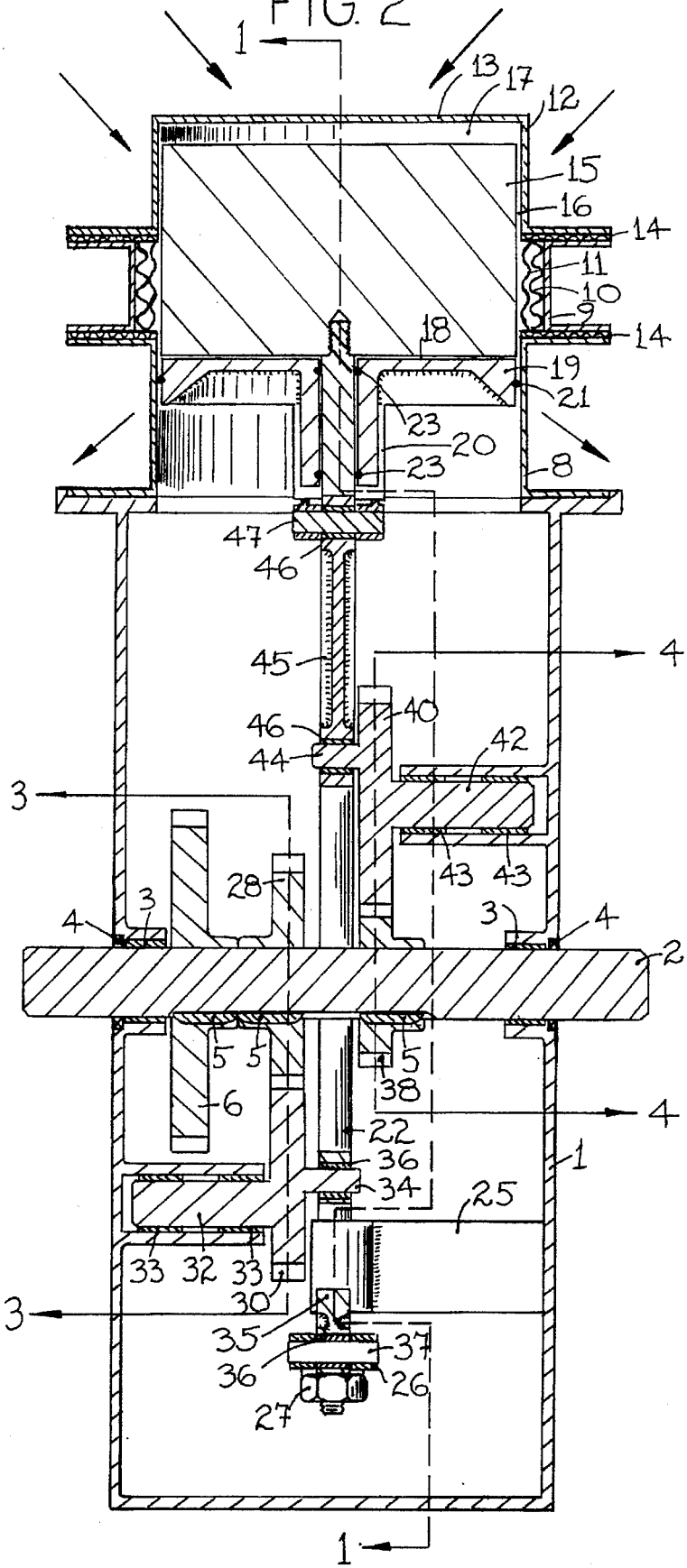
FIG. 2 is a longitudinal section view through the preferred embodiment taken at 90 degrees to FIG. 1 and made to the same scale as FIG. 1.
Figure 3:
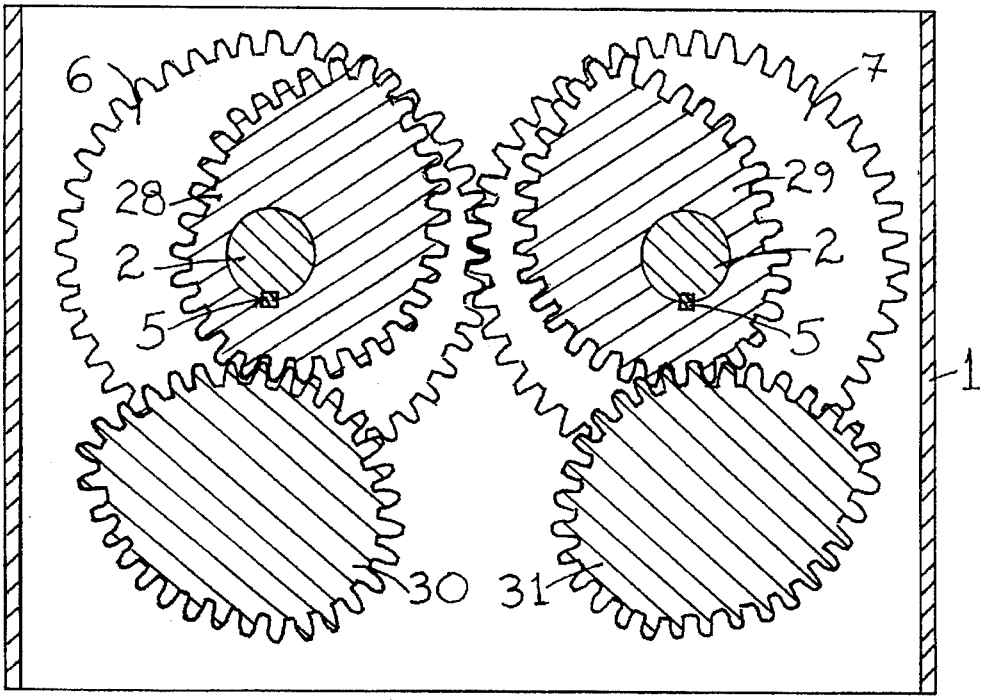
FIG. 3 is a transverse section view of the non-circular gears transmission trains serving the displacer piston, the twin counterpart mainshafts, and in the background the circular gears transmission train relating the twin counterpart mainshafts, made to the same scale as FIG. 1.
Figure 4:
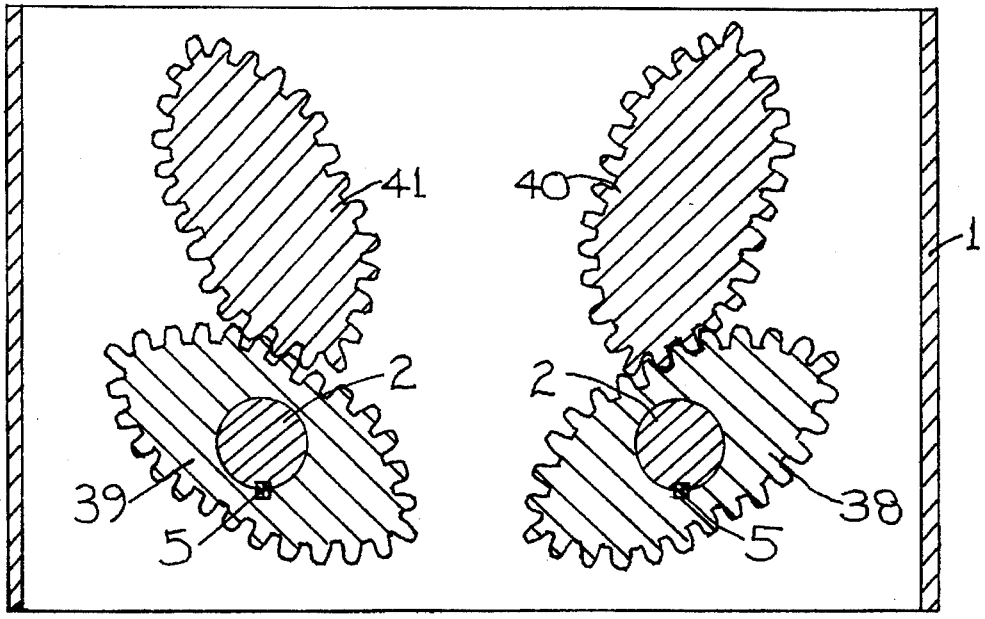
FIG. 4 is a transverse section view of the non-circular gears transmission trains serving the power piston, made to the same scale as FIG. 1.

The content of the present invention is conveyed in detail by the aid of the preferred embodiment illustrated by FIGS. 1 through 6. FIGS. 1 and 2 are transverse and longitudinal section views to the same scale, and when taken together describe the disposition of components of the preferred embodiment at zero degrees mainshaft rotation which is the beginning of the working gas expansion stroke.

Into engine block 1 are located twin counterpart mainshafts 2, each mainshaft rotatively supported on two bearings 3 and sealed from the outside environment by seals 4. Mainshafts 2 have rigidly affixed to them by means of keys 5 circular gear 6 (the left counterpart gear) and circular gear 7 (the right counterpart gear) which together are a matched left and right hand pair which engage each other so that mainshafts 2 rotate at equal speeds in opposite directions to each other, as indicated by the twin curved arrows on FIG. 1.

Affixed to the open top of block 1 is cold cylinder 8, which is a cylinder with flanges whose cylinder walls conduct heat outward, as indicated by the outward-pointing arrows on FIGS. 1 and 2 from the cylinder interior to a heat receptor medium on its outside. Affixed to the top of cold cylinder 8 is a second cylinder with flanges forming the shell of regenerator 9, which contains an annular insulation 10 and a corrugated annular heat sink 11. Affixed to the top of regenerator 9 is hot cylinder 12 which includes a cylinder head 13. Regenerator 9 is thermally insulated from cold cylinder 8 and hot cylinder 12 by thermal insulation gaskets 14. The walls of hot cylinder 12 conduct heat inward from an external heat source as indicated by the inward-pointing arrows of FIGS. 1 and 2. The bores of cold cylinder 8, regenerator 9, and hot cylinder 12 are all circular and coaxial, and collectively they form the engine cylinder which contains the engine working gas.

Located within the engine cylinder is displacer piston 15 which is thermally insulated on its outside surfaces to reduce heat transfer within the cylinder. Hot chamber 17 is formed between the top of displacer piston 15, hot cylinder 12 and cylinder head 13. Displacer piston 15 is concentric to said engine cylinder and separated from it by annular gas passage 16, which serves to communicate hot chamber 17 with regenerator 9, and which serves to communicate regenerator 9 with cold chamber 18 formed between the bottom of displacer piston 15, the cylinder bore of cold cylinder 8, and the top of power piston 19. Power piston 19 is constructed of heat conducting material to conduct heat out of cold chamber 18, and power piston 19 has integral to it power piston crosshead yoke 20. The outer diameter of power piston 19 includes means to carry power piston sealing ring 21 to seal power piston 19 against the cylinder bore of cold cylinder 8, to prevent the working gas quantity within the engine cylinder from escaping, and to cause power piston 19 to travel concentric to said cylinder bore. Rigidly affixed to the lower end of displacer piston 15 and concentric to it is displacer piston shaft 22. Displacer piston shaft 22 is borne and sealed on its upper end by two seals 23, and displacer piston shaft 22 is borne on its lower end by bearing 24. Bearing 24 is rigidly held in place by pedestal 25 which is rigidly affixed to engine block 1. The lower end of displacer piston shaft 22 is stepped and threaded to receive displacer piston crosshead yoke 26, which is rigidly affixed to displacer piston shaft 22 by nut 27.

Rigidly affixed to twin counterpart mainshafts 2 by means of keys 5 are non-circular displacer piston driving gear 28 (the left counterpart gear) and non-circular displacer piston driving gear 29 (the right counterpart gear). Gears 28 and 29 are identical but opposite handed and are shown in full section in FIG. 3, and in the preferred embodiment they are of unilobed logarithmic spiral shape of unequal sectors. Gear 28 engages with and drives a non-circular displacer piston driven gear 30 (the left counterpart gear). Gear 30 is shown in full section in FIG. 3, in the preferred embodiment it is of unilobed logarithmic spiral shape of unequal sectors, and it is identical in profile to gear 28. Gear 29 engages with and drives a non-circular displacer piston driven gear 31 (the right counterpart gear). Gear 31 is shown in full section in FIG. 3, in the preferred embodiment it is of unilobed logarithmic spiral shape of unequal sectors, and it is identical in profile to gear 29. Gears 30 and 31 are affixed with cantilevered shafts 32 by which said gears are rotatively supported in engine block 1 by means of bearings 33. Gears 30 and 31 are affixed with cantilevered displacer piston crankpins 34. Crankpin 34 of driven gear 30 is rotatively linked to the left-hand end of displacer piston crosshead yoke 26 by connecting rod 35, said rod being equipped with bearings 36 in bores in its two ends, said rod being rotatively fixed to said crosshead yoke by displacer piston connecting rod pin 37. Crankpin 34 of driven gear 31 is rotatively linked to the right-hand end of displacer piston crosshead yoke 26 by connecting rod 35, said rod being equipped with bearings 36 in bores in its two ends, said rod being rotatively fixed to said crosshead yoke by displacer piston connecting rod pin 37.

By means of the kinematic transmission trains described in the preceding paragraphs, rotation of either of twin counterpart mainshafts 2 causes both mainshafts to rotate and said rotation produces linear motion of displacer piston 15 and vice-versa, whose maximum and minimum speeds occur at unequal intervals. Said motion is shown by the dashed line of FIG. 5 labeled "POSITION OF DISPLACER PISTON", in which the upper abscissa line defines degrees of mainshaft rotation, and in which the ordinate defines linear piston travel along the engine cylinder axis, zero being nearest to cylinder head 13. Zero degrees of said abscissa represents the beginning of the gas expansion stroke, which is the disposition of the engine components shown in FIGS. 1 through 4. Beginning at zero degrees mainshaft rotation the motion of the displacer piston is to travel from an intermediate location in the engine cylinder to its position farthest from the cylinder head in approximately 90 degrees of mainshaft rotation, then to return travel full stroke to its position nearest the cylinder head in approximately 90 degrees of mainshaft rotation, then to remain at its position nearest the cylinder head for approximately 90 degrees of mainshaft rotation, and then to travel to said intermediate position in approximately 90 degrees of mainshaft rotation so as to complete a full 360 degrees of a mainshaft rotation which equals one engine cycle.

Rigidly affixed to twin counterpart mainshafts 2 by means of keys 5 are non-circular power piston driving gear 38 (the left counterpart gear) and non-circular power piston driving gear 39 (the right counterpart gear). Gears 38 and 39 are equal but opposite handed and are shown in full section in FIG. 4 in reversed hand, and in the preferred embodiment they are of bilobed logarithmic spiral shape. Gear 38 engages with and drives non-circular power piston driven gear 40 (the left counterpart gear). Gear 40 is shown in full section in FIG. 4, in the preferred embodiment it is of bilobed logarithmic spiral shape, and it is identical in profile to gear 38. Gear 39 engages with and drives non-circular power piston driven gear 41 (the right counterpart gear). Gear 41 is shown in full section in FIG. 4, in the preferred embodiment it is of bilobed logarithmic spiral shape, and it is identical in profile to gear 39. Gears 40 and 41 are affixed with cantilevered shafts 42 by which said gears are rotatively supported in engine block 1 by means of bearings 43. Gears 40 and 41 are affixed with cantilevered power piston crankpins 44. Crankpin 44 of driven gear 40 is rotatively linked to the left-hand end of power piston crosshead yoke 20 by connecting rod 45, said rod being equipped with bearings 46 in bores in its two ends, said rod being rotatively fixed to said crosshead yoke by power piston connecting rod pin 47. Crankpin 44 of driven gear 41 is rotatively linked to the right-hand end of power piston crosshead yoke 20 by connecting rod 45, said rod being equipped with bearings 46 in bores in its two ends, said rod being rotatively fixed to said crosshead yoke by power piston connecting rod pin 47.

By means of the kinematic transmission trains described in the preceding paragraphs, rotation of either of twin counterpart mainshafts 2 causes both mainshafts to rotate and said rotation produces linear motion of power piston 19 and vice-versa, which is irregular compared to said rotation by consisting of four separate intervals. Said motion is shown by the solid line of FIG. 5 labeled "POSITION OF TOP OF POWER PISTON", in which the upper abscissa line defines degrees of mainshaft rotation, and in which the ordinate defines linear piston travel along the engine cylinder axis, zero being nearest to cylinder head 13 or contracted position. Zero degrees of said abscissa represents the beginning of the gas expansion stroke, which is the disposition of the engine components shown in FIGS. 1 through 4. Beginning at zero degrees mainshaft rotation the motion of the power piston is to travel from its position nearest the cylinder head full stroke to its position farthest from the cylinder head in approximately 90 degrees of mainshaft rotation, then to remain at its position farthest from the cylinder head for approximately 90 degrees of mainshaft rotation, then to travel full stroke to its position nearest the cylinder head in approximately 90 degrees of mainshaft rotation, and then to remain at its position nearest the cylinder head for approximately 90 degrees of mainshaft rotation so as to complete a full 360 degrees of a mainshaft rotation, which equals one engine cycle.

At any time in the engine cycle the working gas is contained within the annular space of regenerator 9, annular gas passage 16, hot chamber 17, cold chamber 18, the annular space formed between the outside diameter of power piston 19 and the inner bore of cold cylinder 8 up to power piston sealing ring 21, and the annular space formed by the outside diameter of displacer piston shaft 22 and the inner bore of power piston crosshead yoke 20 up to the first displacer piston shaft seal 23. At any time some of the working gas is not available for transfer, namely that portion of the working gas in the clearance space between the top of displacer piston 15 and cylinder head 13 when displacer piston 15 is closest to said cylinder head, that portion of the working gas residing in the clearance space between the top of power piston 19 and the bottom of displacer piston 15 when they are closest to each other, that portion of the working gas residing in the annular space of regenerator 9, that portion of the working gas residing in annular gas passage 16, and that portion of the working gas residing in the last two annular spaces described in the previous sentence. Said portions of working gas not available for transfer, in whole or part, are hereinafter called inactive working gas volumes.

Figure 5:
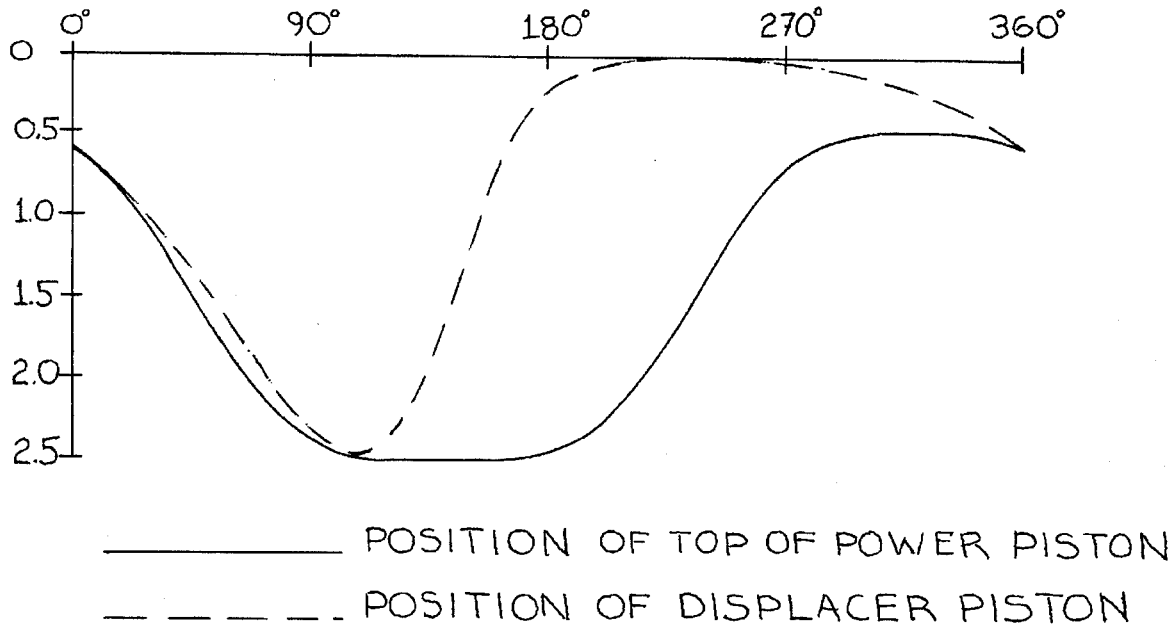
FIG. 5 is a diagram showing the relationship of the top of the power piston to the bottom of the displacer piston, and the top of the displacer piston to the cylinder head, for all angles of rotation of the engine mainshaft in the preferred embodiment.

When the motions of displacer piston 15 and power piston 19 are considered in the engine cylinder of the preferred embodiment the position of power piston 19 alone determines the working gas volume, and the position of displacer piston 15 relative to the top of power piston 19 and cylinder head 13 of hot cylinder 12 alone determines whether the engine working gas is in hot chamber 17 or in cold chamber 18, excepting said inactive working gas volumes. Referring to FIG. 5 and considering the relationships of the motions of displacer piston 15 and of power piston 19 when referred to the mainshaft rotation shows the working gas volume to operate in the four requisite strokes of the Stirling cycle, excepting the effects of said inactive working gas volumes. The said four strokes in the preferred embodiment consist of the working gas expansion at a constant high temperature from zero degrees to 108 degrees mainshaft rotation, transfer of the working gas at constant volume from the hot chamber to the cold chamber from 108 degrees to 187 degrees mainshaft rotation, contraction of the working gas at a constant low temperature from 187 degrees to 285 degrees mainshaft rotation, and transfer of the working gas at constant volume from the cold chamber back to the hot chamber from 285 degrees to 360 degrees mainshaft rotation, excepting in all four strokes the effects of said inactive working gas volumes. In the preferred embodiment one mainshaft rotation equals one working gas cycle, also referred to as one engine cycle, consisting of the said four strokes.

Figure 6:
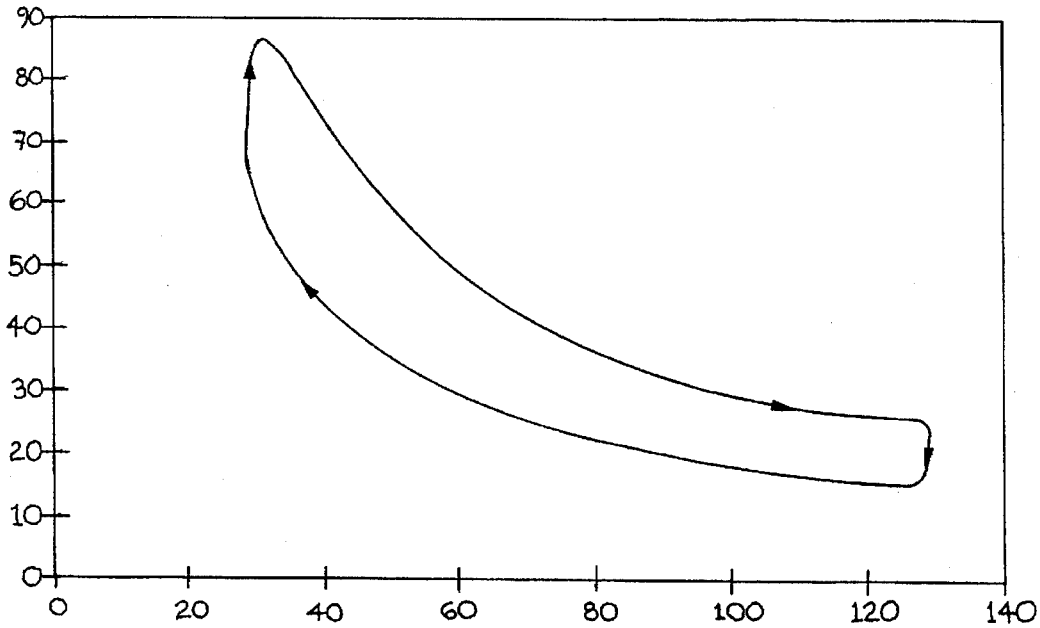
FIG. 6 is a diagram showing the relationship between the working gas pressure as ordinate and the total working gas volume as abscissa for a complete engine cycle of the preferred embodiment.

FIG. 6 is an indicator diagram of a Stirling engine constructed in accordance with the preferred embodiment of the invention. The abscissa shows the engine working gas volume in cubic inches and the ordinate shows the engine working gas pressure in pounds force per square inch absolute. The closed figure indicates a complete cycle of the pressures and volumes experienced by the working gas during the four strokes described in the preceding paragraph, in the direction of the arrows, and the area within the closed figure is a measure of the net work of the cycle. The 108 degrees mainshaft rotation expansion at high working gas temperature stroke is the longer, upper curve sweeping from left to right. The two transfer strokes from the hot to cold chambers and from the cold to hot chambers are represented by near vertical lines indicating little working gas volume change during said transfer strokes.

The spirit and intent of the invention is to optimize the motions of the displacer piston and power piston of a Stirling engine by kinematic transmission so that during the expansion stroke the working gas remains within the hot chamber excepting the effects of inactive working gas volumes, so that during the hot chamber to cold chamber working gas transfer stroke said working gas volume remains constant, so that during the contraction stroke the working gas remains within the engine cold chamber excepting the effects of inactive working gas volumes, and so that during the cold chamber to hot chamber working gas transfer stroke said working gas volume remains constant. The invention is not limited to the preferred embodiment presented above, but includes changes and modifications to achieve said optimization of motion. Said changes and modifications include strokes of mainshaft rotation values other than 90 degrees, non-circular gear shapes other than logarithmic spirals, variation of connecting rod lengths, variation of eccentricity of gearing centers of rotation relative to piston crosshead yoke connecting rod pin centers, and variation of the radius and angular relationship of driven gear crankpin centers to the centers of rotation of their respective gears. The present invention achieves the reversibility of the Stirling cycle by deriving its motions from continuous kinematic transmission, so it functions not only as an engine, but when driven in reverse it functions as a heat pump.

What is claimed is:

1. A hot gas engine operating in accordance with the Stirling cycle including:

a hot cylinder forming a hot chamber in which heat can be added to working gas in said chamber from an external source;

a displacer piston able to reciprocate in said hot cylinder, said displacer piston determining the volume of working gas within said hot chamber;

a regenerator being a heat sink which extracts heat from working gas hotter than said regenerator flowing through said regenerator and delivers heat to working gas colder than said regenerator flowing through said regenerator;

a cold cylinder forming a cold chamber in which heat can be rejected from working gas in said chamber to an external receptor;

a power piston able to reciprocate in said cold cylinder, said power piston determining the volume of working gas within said cold chamber;

a passage communicating said regenerator to said hot chamber so that working gas may travel from said hot chamber to said regenerator and vice-versa;

a passage communicating said regenerator to said cold chamber so that working gas may travel from said cold chamber to said regenerator and vice-versa;

a quantity of working gas contained within said hot chamber, said passages, said regenerator, said cold chamber, and the clearance spaces associated with said hot cylinder and said cold cylinder;

a mainshaft;

a displacer piston kinematic transmission train consisting of a non-circular displacer piston driving gear affixed to said mainshaft driving a non-circular displacer piston driven gear, said driven gear driving a displacer piston crank journal by which it is connected by a connecting rod to said displacer piston so that rotary motion of said mainshaft is converted into longitudinal motion of said displacer piston within said hot cylinder, and vice-versa;

a power piston kinematic transmission train consisting of a non-circular power piston driving gear affixed to said mainshaft driving a non-circular power piston driven gear, said driven gear driving a power piston crank journal by which it is connected by a connecting rod to said power piston so that rotary motion of said mainshaft is converted into longitudinal motion of said power piston within said cold cylinder, and vice-versa;

a relationship between the said motions of said power piston and the said motions of said displacer piston such that said working gas experiences four separate and contiguous strokes during the engine cycle, said strokes being an expansion stroke during which on a time-basis average at least 82 percent of the total volume of said working gas remains within said hot chamber, then a stroke to transfer at least 90 percent of the total volume of said working gas from said hot chamber to said cold chamber during which stroke the total volume of said working gas changes no more than 4 percent, then a contraction stroke during which on a time-basis average at least 95 percent of the total volume of said working gas remains within said cold chamber, and to complete said cycle a final stroke to transfer at least 70 percent of the total volume of said working gas from said cold chamber to said hot chamber during which stroke the total volume of said working gas changes no more than 12 percent.

2. A hot gas engine as in claim 1, wherein said non-circular displacer piston driving gear and said non-circular displacer piston driven gear are of elliptical shape.

3. A hot gas engine as in claim 1, wherein said non-circular displacer piston driving gear and said non-circular displacer piston driven gear are of unilobed logarithmic spiral shape.

4. A hot gas engine as in claim 1, wherein said non-circular displacer piston driving gear and said non-circular displacer piston driven gear are of unilobed logarithmic spiral shape of unequal sectors.

5. A hot gas engine as in claim 1, wherein said non-circular power piston driving gear and said non-circular power piston driven gear are of bilobed elliptical shape.

6. A hot gas engine as in claim 1, wherein said non-circular power piston driving gear and said non-circular power piston driven gear are of bilobed logarithmic spiral shape.

7. A hot gas engine as in claim 1, wherein said non-circular power piston driving gear and said non-circular power piston driven gear are of unsymmetrical bilobed logarithmic spiral shape.

8. A hot gas engine as in claim 1, wherein said displacer piston crank journal is a cantilevered displacer piston crankpin affixed to said displacer driven gear.

9. A hot gas engine as in claim 1, wherein said power piston crank journal is a cantilevered power piston crankpin affixed to said power piston driven gear.

10. A hot gas engine as in claim 1, wherein said displacer piston crank journal is a throw on a displacer piston crankshaft affixed to said displacer piston gear.

11. A hot gas engine as in claim 1, wherein said power piston crank journal is a throw on a power piston crankshaft affixed to said power piston gear.

12. A hot gas engine as in claim 1, wherein said mainshaft becomes twin counterpart mainshafts that rotate at equal speeds to each other in opposite directions to each other, wherein said displacer piston kinematic transmission train consists of two counterpart transmission trains operating at equal motions to each other in opposite directions each connected to the same said displacer piston, and wherein said power piston kinematic transmission train consists of two counterpart transmission trains operating at equal motions to each other in opposite directions each connected to the same said power piston.

* * * * *